US005601480A

United States Patent [19]

Nilén

[11] Patent Number: 5,601,480

[45] Date of Patent: Feb. 11, 1997

[54] CLEANING MACHINE FOR TREATING GOODS WITH LIQUID AND GRANULES

[75] Inventor: Bengt Nilén, Landskrona, Sweden

[73] Assignee: PW-System AB, Landskrona, Sweden

[21] Appl. No.: 325,334

[22] PCT Filed: Apr. 22, 1993

[86] PCT No.: PCT/SE93/00351

§ 371 Date: Oct. 24, 1994

§ 102(e) Date: Oct. 24, 1994

[87] PCT Pub. No.: WO93/21814

PCT Pub. Date: Nov. 11, 1993

[30] Foreign Application Priority Data

Apr. 24, 1992 [SE] Sweden ..... 9201304

[51] Int. Cl.[6] ..... B24C 3/04; B24C 9/00

[52] U.S. Cl. ..... 451/88; 451/89

[58] Field of Search ..... 451/87, 88, 89, 451/99, 66

[56] References Cited

U.S. PATENT DOCUMENTS

| | | | |
|---|---|---|---|
| 2,395,160 | 2/1946 | Anderson | 451/89 |
| 3,012,262 | 12/1961 | Mori | 451/99 |
| 3,323,159 | 6/1967 | Ummel et al. | 15/3 |
| 3,455,062 | 7/1969 | Eppler | 451/88 |
| 3,553,895 | 1/1971 | Power | 451/87 |
| 4,374,443 | 2/1983 | Mosell | 134/7 |
| 5,056,274 | 10/1991 | Stern | 451/88 |

*Primary Examiner*—Robert A. Rose

*Attorney, Agent, or Firm*—Tarolli, Sundheim, Covell, Tummino & Szabo

[57] ABSTRACT

A cleaning machine for treating goods with liquid only or with liquid mixed with granules which are heavier than the liquid, comprises a treating chamber (2), a pump device (3, 4) for circulating the liquid with or without granules and discharge thereof through nozzles (8) towards the goods in the treating chamber (2), and a collecting container (1) located beneath the treating chamber (2) and having a space (9) for liquid and granules, which space (9) communicates with said treating chamber (2). In order to provide a cleaning machine which, while permitting shifting in a simple manner between liquid with granules and liquid without granules while treating goods located in the treating chamber, also permits such shifting with only stationary members for obtaining the highest possible wear resistance, the space (9) for liquid and granules is by means of a separating means (10) divided into a section (11) containing granules and liquid and a section (12) containing only liquid, whereby the section (11) containing granules and liquid is connected with a first separate pump (4) in the pump device and the section (12) containing only liquid is connected with a second separate pump (3) in the pump device, for treatment with either granules and liquid or liquid only.

14 Claims, 1 Drawing Sheet

CLEANING MACHINE FOR TREATING GOODS WITH LIQUID AND GRANULES

The present invention relates to a cleaning machine for treating goods in accordance with the preamble of claim 1.

A prior art device for separating granules from the circulating liquid flow is described in EP-B-0 169 847. In the tank where the liquid is collected, the granules sink to the bottom, and when the liquid and the granules are to be brought to the nozzles, the liquid is drawn from a lower level adjacent to the bottom of the tank so that the granules are drawn with the liquid, and when only the liquid is to be brought to the nozzles, the liquid is taken from a higher level well above the layer of granules at the bottom of the tank so that said granules are not drawn with the liquid flow.

Another separating principle is described in SE-B-464 387. A collecting container defines two spaces of which one at the top communicates with the treating chamber while the other at the top is separated from the treating chamber, and between said spaces there is provided a bottom groove which communicates with a pump, and a partition which permits flow of liquid between the two spaces and which is pivotable about a vertical axis between two end positions for preventing passage of the granules to the bottom groove in one end position and permit such passage in the other end position.

One object of the invention is to provide a cleaning machine which permits shifting between liquid with granules and liquid without granules while treating goods located in the treating chamber.

Another object is to provide a cleaning machine of only stationary members for obtaining the highest possible wear resistance.

A further object is to be able to shift between cleaning with and without granules in a simple manner.

A still further object is to be able to carry out an additional treatment with granules, when required, independent of the cleaning program set.

According to the invention, for attaining said objects, a cleaning machine of the abovementioned type has received the characterizing features of claim 1.

Figure 1:
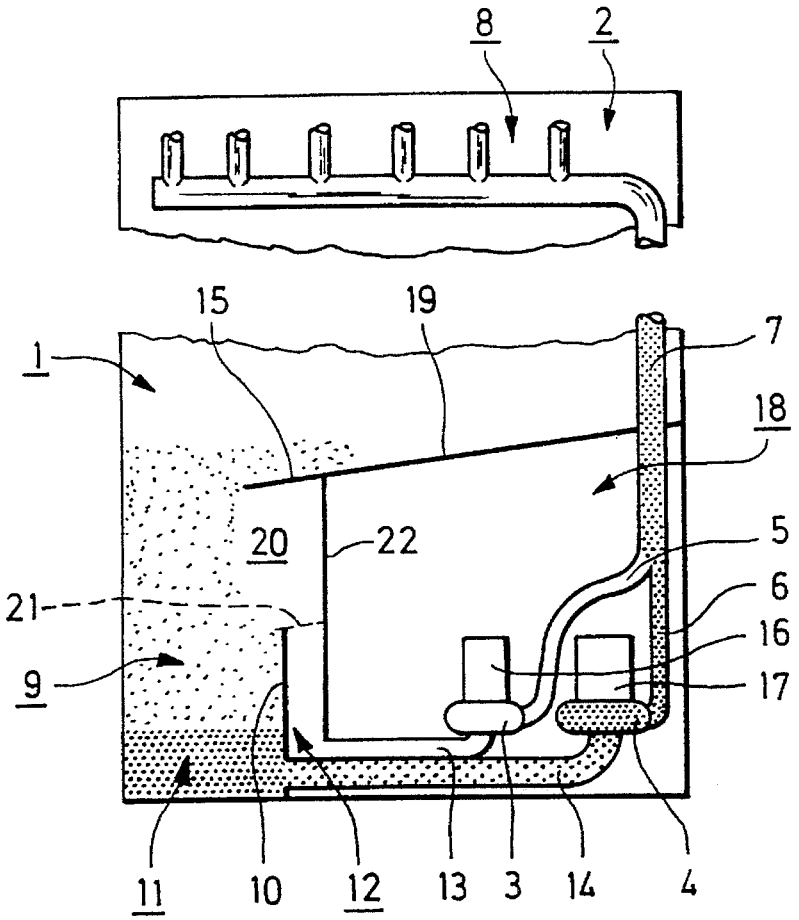
Figure 2:
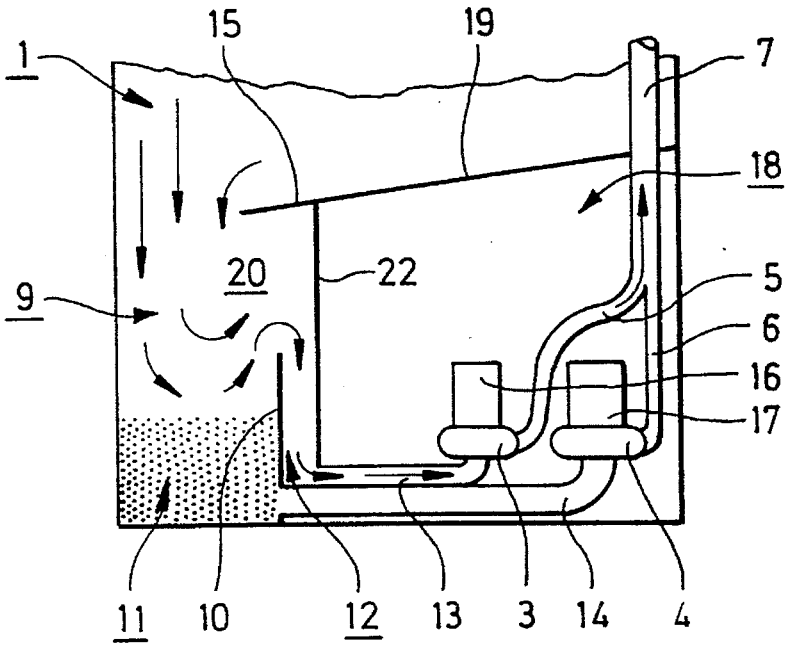

The invention will be further described below with reference to the accompanying drawing, in which FIG. 1 is a vertical sectional view of the lower portion of a cleaning machine according to the invention, showing the separated granules; and FIG. 2 is a vertical sectional view of the collecting container with arrows showing the liquid flow while cleaning with liquid only.

The cleaning machine illustrated in the drawings comprises a collecting container 1 which is situated beneath a partially and schematically illustrated treating chamber 2 wherein goods to be cleaned are located. This treating chamber is accessible through an opening in the shape of a lid or door (not shown) in a conventional manner, and it has a suitable stand for carrying the goods in the chamber. Beneath the treating chamber 2 in the collecting container 1, there are provided, in the embodiment shown, two spaces 9, 18 of which one space 18 is closed and the other space 9 is open. The closed space 18 contains a pump device consisting of two pumps 3, 4 which are operated by motors 16 and 17 respectively. Alternatively, the pumps 3, 4 can each be located in a separate closed space, whereby said closed spaces can be provided e.g. in diametrically opposed positions in the collecting container or at opposite walls thereof. It is also possible to locate the pumps 3, 4 in a space outside the collecting container 1, on the outer side of the cleaning machine or even outside the cleaning machine on any suitable location for the purpose. In the embodiment shown however, with both pumps 3, 4 in a common closed space 18, delivery conduits 5, 6 extend from the pressure side of the pumps 3, 4 and are thereafter brought together to a common delivery conduit 7 which goes up into the treating chamber 2, whereby one or more ramps of nozzles 8 are connected with the delivery conduit 7. At the transition to the common delivery conduit 7, non return valves can be provided in each delivery conduit 5, 6. The pumps 3, 4 are preferably centrifugal pumps, whereby the capacity of the pump 3, intended for feeding liquid, is less than the capacity of the pump 4, intended for feeding liquid and granules. The pump 3 has e.g. a capacity of 350 liters per minute, while the pump 4 has a capacity of e.g. 700 liters per minute. The closed space 18 comprises an upper member 19 sloping inwards towards the middle of the collecting container such that liquid with or without granules can run off said upper member, whereby said upper member 19 also includes a protruding or projecting portion 15 which extends over the other, open space 9 of the collecting container 1.

The open space 9 of the collecting container 1, which space thus communicates with the treating chamber 2, is divided into two sections 11, 12 by means of a separating means in the shape of e.g. an unbroken or an at least partially perforated plate 10, whereby said plate extends some distance upwards into the container 1 from the bottom thereof; in the embodiment shown however, not the entire distance up to the protruding portion 15. The plate 10 can be perforated with holes of a dimension which is less than the size of the granules. The space 9 consists of a larger section 11 containing liquid and granules and of a smaller section 12 containing only liquid. The larger section 11 containing liquid and granules is connected with the pump 4 by means of a feed conduit 14 and the section 12 containing only liquid is connected with the pump 3 by means of a feed conduit 13.

In a start position the open space 9 contains liquid and granules in the larger section or compartment 11, with the granules at the bottom because of their higher density, and liquid in the smaller section 12.

If there is a need for cleaning the goods in the treating chamber 2 with liquid and granules, the pump 4, operated by the motor 17, is started and liquid from the larger section 11, with granules mixed therein, is drawn into the feed conduit 14 for feeding the liquid with granules entrained therein through the delivery conduit 6, the common delivery conduit 7 and the nozzles 8, and discharge thereof towards the goods located in the treating chamber 2. After contact with the goods, the granules fall down from the treating chamber 2 and reach the space 9 in the collecting container 1 either directly or via the upper member 19 of the closed space 18, whereby they finally, by means of the separating plate 10 and the projecting or protruding portion 15, which preferably covers at least the entire section 12 from above, reach the larger section 11, wherein the granules remain while liquid also flows into the smaller section 12 through the perforations in the separating plate 10 and/or through the opening 20 from the larger section 11 into the smaller section 12, said opening 20 being defined by said protruding portion 15 and said separating plate 10 (see FIG. 1). Alternatively, instead of providing the protruding portion 15 of the upper member 19 of the closed space 18 for facilitating separation of granules from liquid flowing into the smaller section 12, at a lower level locate un unbroken or preferably an entirely or partially perforated second plate 21 (shown with broken lines in FIG. 1) to cover substantially the entire section 12 from above, whereby this second plate 21 preferably extends from near the upper edge of the separating plate 10 obliquely upwards towards the closed space 18, when there is such a space, to the wall 22 of said closed space 18 facing the open space 9. According to a particularly simple embodiment, this second plate 21 is formed by an angular extension of the separating plate 10. It should be noticed that if the separating plate 10 is unbroken, the second plate 21 must be perforated or vice versa. Preferably however, the separating plate 10 as well as the second plate 21 are at least partially perforated.

If instead treatment of the goods with only liquid is desired, the pump 4 is deactivated, whereby the granules, because of their higher density relative to the liquid, fall to the bottom, whereafter the pump 3 is started such that liquid from the smaller section 12 is drawn into the feed conduit 13 for discharge through the delivery conduit 5, the common delivery conduit 7 and the nozzles 8 towards the goods located in the treating chamber 2. Thereafter, the liquid flows directly or via the sloping upper member 19 down into the space 9 for mixing with the granules at the bottom of the larger section 11 and through the opening 20 and eventually also the separating plate 10 into the smaller section 12 (see FIG. 2).

According to a preferred embodiment, the conduits 13, 14 are provided with any type of screen or sieve (not shown) at their inlet ends for preventing foreign objects such as knifes, forks, remains of food etc. from finding their way into the conduits and, as an additional precautionary measure, preventing the granules from penetrating into the conduit 13 intended for liquid only.

In the above manner shifting may occur between treatment with and without granules, and shifting may occur automatically be means of a simple settable time control unit for adjustment of the processing times or times of treatment. Shifting may also occur manually through separate control means for each pump, which e.g. permits extra treatment with granules if this is required. Thus, the invention permits separation in a simple manner with only stationary members, providing a robust construction with a long term of life, since movable elements have a greater tendency to brake than stationary or fixed members.

The term "liquid" as used herein includes primarily water, but may also comprise water mixed with a cleaning agent. In certain applications, the liquid may consist of one or more organic solvents.

I claim:

1. Cleaning machine for alternative treatment of goods with liquid only or with liquid mixed with granules which are heavier than the liquid, said cleaning machine comprising a treating chamber (2);

a pump device (3, 4) for circulating the liquid with or without granules and discharge thereof through nozzles (8) towards the goods in said treating chamber (2); and a collecting container (1) located beneath said treating chamber (2);

said collecting container (1) comprising a space (9) for liquid and granules, said space (9) communicating with said treating chamber (2), said space (9) being divided by means of a separating means (10) into a first section (11), containing granules and liquid, and a second section (12), containing liquid only; and said collecting container (1) further comprising at least one closed space (18);

said pump device (3, 4) having a first pump (4) and a second pump (3), said second pump (3) being separate from said first pump (4), said first and second pumps (4 and 3) being provided in said closed space (18);

said first section (11) being connected with said first pump (4) and said second section (12) being connected with said second pump (3); and said first and second pumps (4, 3) being selectively operable for treatment of the goods in said treating chamber (2) either with granules and liquid by operation of said first pump (4) or with liquid only by operation of said second pump (3).

2. Cleaning machine according to claim 1, wherein said separating means comprises a plate (10) extending upwardly from the bottom of said collecting container (1).

3. Cleaning machine according to claim 1 wherein said plate is at least partially perforated to provide fluid communication between said first and second sections (11 and 12).

4. Cleaning machine according to claim 1, wherein said closed space (18) includes a protruding portion (15) which protrudes out over said space (9) and substantially covers said second section (12) thereby directing granules into said first section (11).

5. Cleaning machine according to claim 4, wherein said upwardly extending plate (10) ends beneath said protruding portion (15) defining an opening (20) therebetween.

6. Cleaning machine according to claim 2, wherein said upwardly extending plate (10) is provided with an angular, at least partially perforated second plate (21) which substantially covers said second section (12) thereby directing granules into said first section (11).

7. Cleaning machine according to claim 1, wherein said second pump (3) of said pump device through a feed conduit (13) is connected with said second section (12) containing liquid only and that a screen is provided in said feed conduit (13) for preventing suction of foreign objects and granules into said conduit.

8. Cleaning machine according to claim 7, wherein said first pump (4) of said pump device through a feed conduit (14) is connected with said first section (11) containing granules and liquid, and that a screen is provided in said feed conduit (14) for preventing suction of foreign objects into said conduit.

9. Cleaning machine according to claim 8, wherein said feed conduits (13, 14) are brought together to a conduit (7) which opens into said nozzles (8).

10. Cleaning machine according to claim 9, wherein automatic control means are provided for the selective operation of said first and second pumps (4, 3) of said pump device.

11. Cleaning machine according to claim 9, wherein manual control means are provided for the selective operation of said first and second pumps (4, 3) of said pump device.

12. Cleaning machine according to claim 1, wherein said closed space (18) is fluid impermeable.

13. Cleaning machine according to claim 1, wherein said first and second pumps (4 and 3) are of the non-submergible type.

14. Cleaning machine for alternative treatment of goods with liquid only or with liquid mixed with granules which are heavier than the liquid, said cleaning machine comprising a treating chamber (2);

a pump device (3, 4) for circulating the liquid with or without granules and discharge thereof through nozzles (8) towards the goods in said treating chamber (2);

a collecting container (1) located beneath said treating chamber (2); and a main delivery conduit (7) extending between and connecting said collecting container (1) and said nozzles (8);

said collecting container (1) comprising a space (9) for liquid and granules, said space (9) communicating with said treating chamber (2), said space (9) being divided by means of a separating means (10) into a first section (11), containing granules and liquid, and a second section (12), containing liquid only; and said collecting container (1) further comprising at least one closed space (18);

said pump device (3, 4) having a first pump (4) and a second pump (3), said second pump (3) being separate from said first pump (4), said first and second pumps (4 and 3) being housed within said closed space (18);

said first pump (4) having a first feed conduit (14) extending between and connecting said first section (11) and said first pump (4), said first pump (4) having a first delivery conduit (6) extending between and connecting said main delivery conduit (7) and said first pump (4);

said second pump (3) having a second feed conduit (13) extending between and connecting said second section (12) and said second pump (3), said second pump (3) having a second delivery conduit (5) extending between and connecting said main delivery conduit (7) and said second pump (3); and said first and second pumps (4, 3) being selectively operable for treatment of the goods in said treating chamber (2) either with granules and liquid by operation of said first pump (4) or with liquid only by operation of said second pump (3).

* * * * *